US009908761B2

(12) United States Patent
Apps et al.

(10) Patent No.: US 9,908,761 B2
(45) Date of Patent: Mar. 6, 2018

(54) PALLET LIFT RAILS

(71) Applicant: Rehrig Pacific Company, Los Angeles, CA (US)

(72) Inventors: William P. Apps, Aplharetta, GA (US); Philip A. King, Sugar Hil, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 14/618,654

(22) Filed: Feb. 10, 2015

(65) Prior Publication Data

US 2015/0298951 A1 Oct. 22, 2015

Related U.S. Application Data

(60) Provisional application No. 61/938,018, filed on Feb. 10, 2014.

(51) Int. Cl.
*B66F 9/12* (2006.01)

(52) U.S. Cl.
CPC ..... *B66F 9/12* (2013.01)

(58) Field of Classification Search
CPC ..... B66F 9/12; B66F 17/003; B66F 9/125; B66F 9/127; B66F 9/144; B66F 9/165; B62B 2203/50; B62B 2203/29; G01G 19/083
USPC ..... 414/607, 785; 187/237
See application file for complete search history.

(56) References Cited

U.S. PATENT DOCUMENTS 1,878,995 A * 9/1932 Abbe ..... B66F 9/12 187/237
2,570,726 A * 10/1951 Smith ..... B66F 9/12 414/437
2,610,751 A * 9/1952 Bevan ..... B66F 9/12 108/52.1
2,795,347 A * 6/1957 Schenkelberger ..... B66F 9/184 414/607
2,818,989 A * 1/1958 Burke ..... B62B 3/06 414/608
3,734,329 A * 5/1973 Grelck ..... B66F 9/12 414/785
3,758,075 A * 9/1973 Briggs ..... B62B 3/06 254/2 R
4,497,606 A * 2/1985 Hobson ..... B66F 9/12 414/607
5,861,580 A * 1/1999 Moore ..... G01G 23/005 177/136
6,186,728 B1 * 2/2001 Michaud ..... B62B 3/0631 254/10 R
2004/0265113 A1 * 12/2004 Quinlan, Jr. ..... B66F 7/08 414/785
2006/0054453 A1 * 3/2006 Marcelli ..... B60P 1/52 193/35 R (Continued)

*Primary Examiner* — Mark C Hageman
(74) *Attorney, Agent, or Firm* — Carlson, Gaskey & Olds PC

(57) ABSTRACT

A fork tine assembly includes a tine having a support surface and an inner surface. A lift rail is movable between a retracted position and a deployed position. The lift rail provides a lift rail support surface higher than the upper surface of the tine when the lift rail is in the deployed position. The lift rail is not an innermost surface of the tine assembly when the lift rail is in the retracted position and when the lift rail is in the deployed position.

23 Claims, 9 Drawing Sheets

(56) References Cited

U.S. PATENT DOCUMENTS

| | | | | |
|---|---|---|---|---|
| 2012/0211308 | A1* | 8/2012 | Issartel | B66F 17/003 187/237 |
| 2013/0223962 | A1* | 8/2013 | Ellington | B62B 3/06 414/495 |
| 2014/0224589 | A1* | 8/2014 | Vetter | B66F 9/12 187/237 |

* cited by examiner

PALLET LIFT RAILS

BACKGROUND

Pallets generally include a deck having an upper surface for supporting goods off the ground. The pallet includes feet or columns for supporting the deck above the ground and for defining space for receiving the forks of a pallet lift.

One existing pallet is typically narrower than standard sized pallets (a "half-size" pallet). It is narrow enough that, when engaged from the short side, the columns of the pallet are received between the forks of the pallet lift and the forks of the pallet lift engage the underside of the deck outward of the columns. However, the forks of the pallet are only partially overlapped by the deck, so the forks protrude outward from the deck too. Therefore, if the selected pallet is between two identical pallets, the forks will also engage the bottom surfaces of the decks on either side of the desired pallet, making it difficult to select and remove one pallet from adjacent pallets.

One proposed solution has been to add a lift rail to each of the forks. The lift rails are each connected to one of the forks by hinges on the facing interior surfaces of the forks. When stowed, the lift rails hang down from the hinges adjacent the facing interior surfaces of the forks. For use, the lift rails are rotated upward until the lift rails are on top of the uppermost surfaces of the forks, adjacent the interior edges thereof. When lifting a pallet, the lift rails engage the pallet of the desired pallet before the forks engage the decks of the adjacent pallets. Thus, the desired pallet can be lifted and removed from between adjacent pallets.

SUMMARY

One drawback of the current design is that the lift rail occupies space between the forks. A fork tine assembly includes a tine having a support surface and an inner surface. A lift rail is movable between a retracted position and a deployed position. The lift rail provides a lift rail support surface higher than the upper surface of the tine when the lift rail is in the deployed position. The lift rail does not decrease the space between the tines in either the retracted or the deployed position.

In one embodiment, the lift rail is elongated and is connected by hinges along the long, lateral edge of the lift rail to the tine. The lift rail is pivoted between a recess in a retracted position and a deployed position.

In another embodiment, the lift rail is pivotably connected at one longitudinal end. The lift rail is generally perpendicular to the tine and is adjacent the lift mechanism when it is in the retracted position. The lift rail is pivoted down onto the tine, parallel to the tine, in the deployed position.

In another embodiment, the lift rail is lifted out of a recess or opening in the tine and pivoted outward on a plurality of pivotably connected arms, pivotably connected at one end to the lift rail at the other end to the tine.

In another embodiment, multiple lift rails on each tine are each lifted from a recess in the tine and then rotated into a deployed position.

BRIEF DESCRIPTION OF THE DRAWINGS

The drawings can be briefly described as follows.

DETAILED DESCRIPTION

Figure 1:
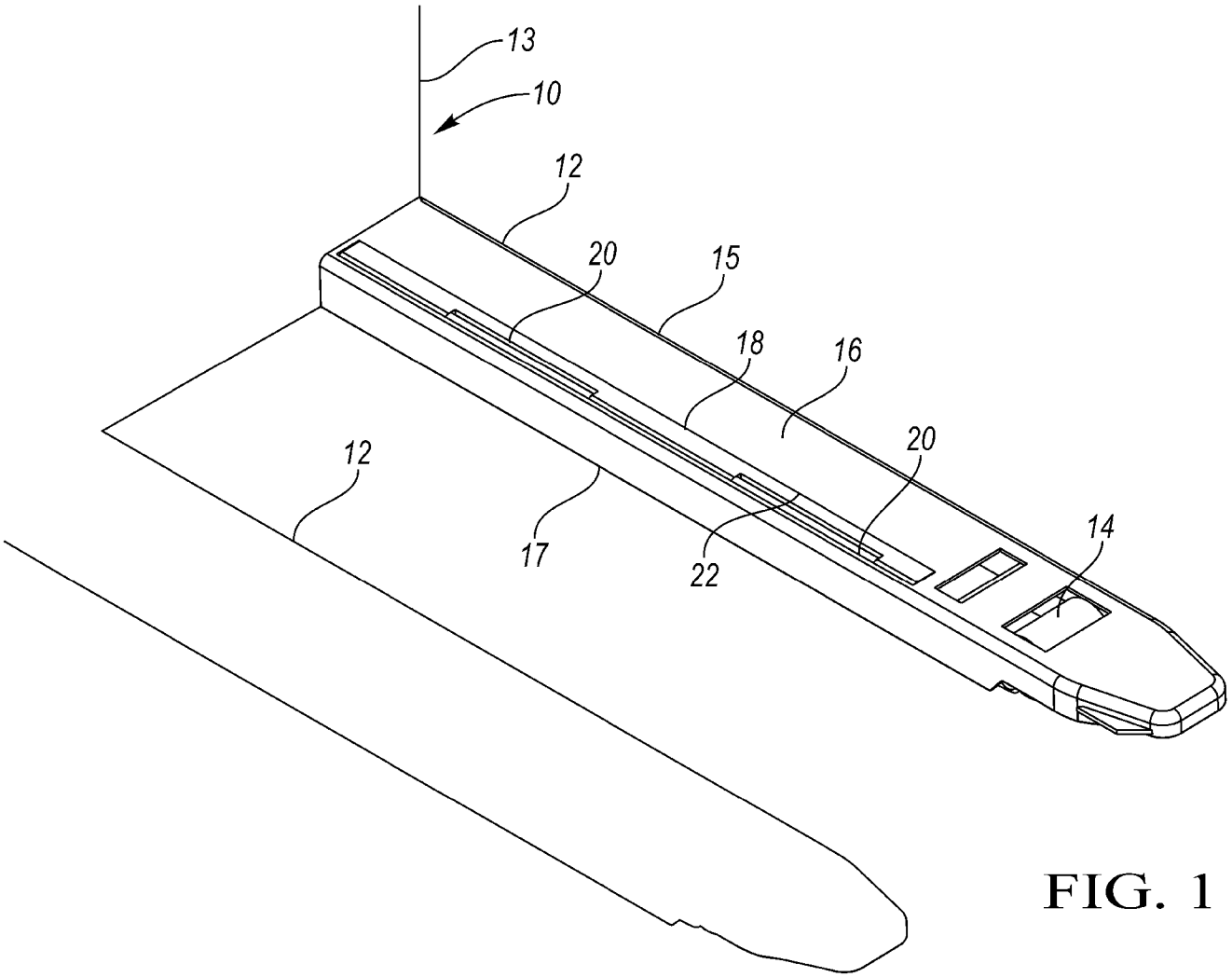
FIG. 1 is a perspective view of a pallet lift according to one embodiment with the lift rail in the retracted position.

An improved pallet lift 10 is shown in FIG. 1. The pallet lift 10 includes a pair of fork tine assemblies 12 (only one shown in detail here and only one will be shown in the rest of the figures, as the other would be the mirror image) operatively connected to a lift mechanism 13 (the lift mechanism may be hydraulic, electric, etc). The fork tine assembly 12 includes a tine 15 having a forward roller 14 spaced away from the lift mechanism 13. The tine 15 includes an upper support surface 16 and an innermost edge 17 facing the other fork tine assembly 12. The fork tine assembly 12 includes a lift rail 18 secured to the tine 15 by hinges 20 adjacent an inner edge of the tine 15. The hinges 20 connect the long, lateral side of the lift rail 18 to the tine 15 at a point spaced just outside the innermost edge 17 of the tine 15.

In the stowed position of FIG. 1, the lift rail 18 is received in a recess or opening 22 formed in the upper surface 16 of the tine 15. In the stowed, retracted position, the lift rail 18 is not the innermost surface between the fork tine assemblies 12 at any point along the length of the fork tine assemblies 12. The lift rail 18 is spaced outwardly (away from the other fork tine assembly 12) from the innermost surface 17 (i.e. the surface facing the other fork tine assembly 12) of the tine 15. In the retracted position, the upper surface of the lift rail 18 is substantially flush with the uppermost support surface 16 of the tine 15, so that the tine assembly 12 can be used to lift pallets or other items.

Figure 2:
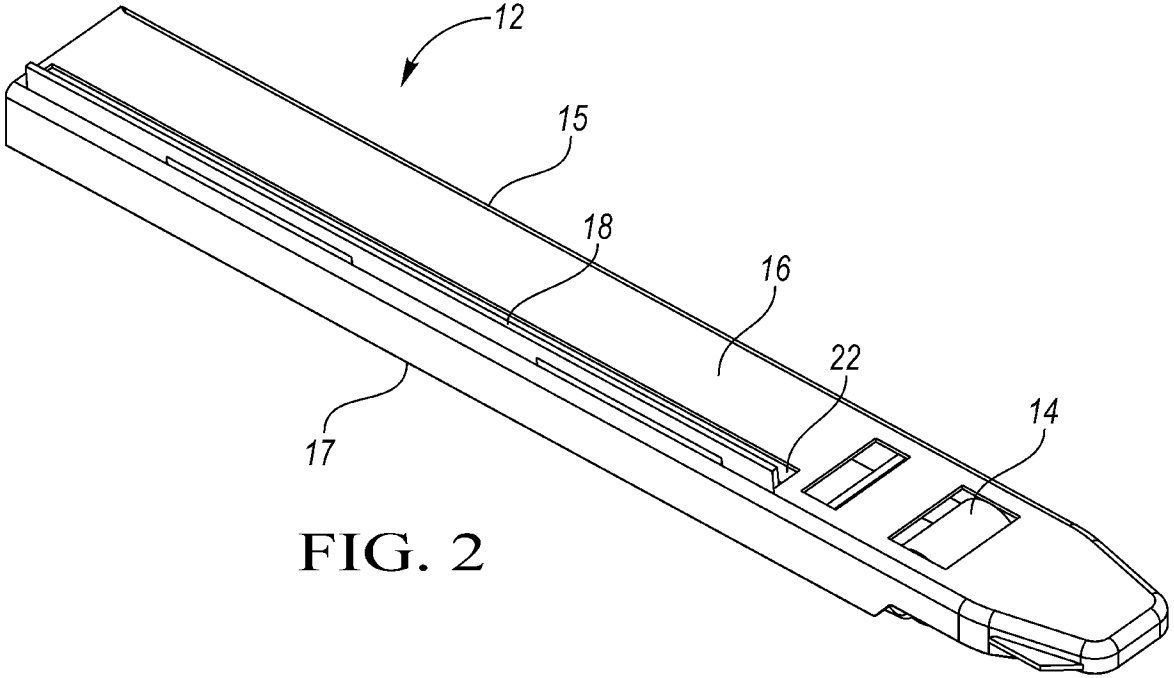
FIG. 2 shows one of the pallet lift tines of FIG. 1 with the lift rail deployed.

The lift rail 18 can be moved from the retracted position of FIG. 1 to the deployed position of FIG. 2 by pivoting the lift rail 18 about the hinges 20 toward the inner edge of the tine 15, either manually or via an actuator, solenoid or mechanical linkage. In the example shown, the lift rail 18 is rotated slightly more than ninety degrees to the deployed position so that it stays in the deployed position. The lift rail 18 is positioned along the inner edge of the upper surface 16 of each tine 15 so that a pallet can be lifted from adjacent a similar pallet. In the deployed position, the lift rail 18 protrudes upwardly of the upper support surface 16 of the tine 15. The lift rail 18 provides a lift rail support surface higher than the upper support surface 16 of the tine 15 when the lift rail 18 is in the deployed position. In the deployed position, the lift rail 18 is not the innermost surface between the fork tine assemblies 12 at any point along the length of the fork tine assemblies 12. In the deployed position, the lift rail 18 is spaced slightly outwardly (away from the other fork tine assembly 12) from the innermost surface (i.e. the surface facing the other fork tine assembly 12) of the tine 15.

Figure 4:
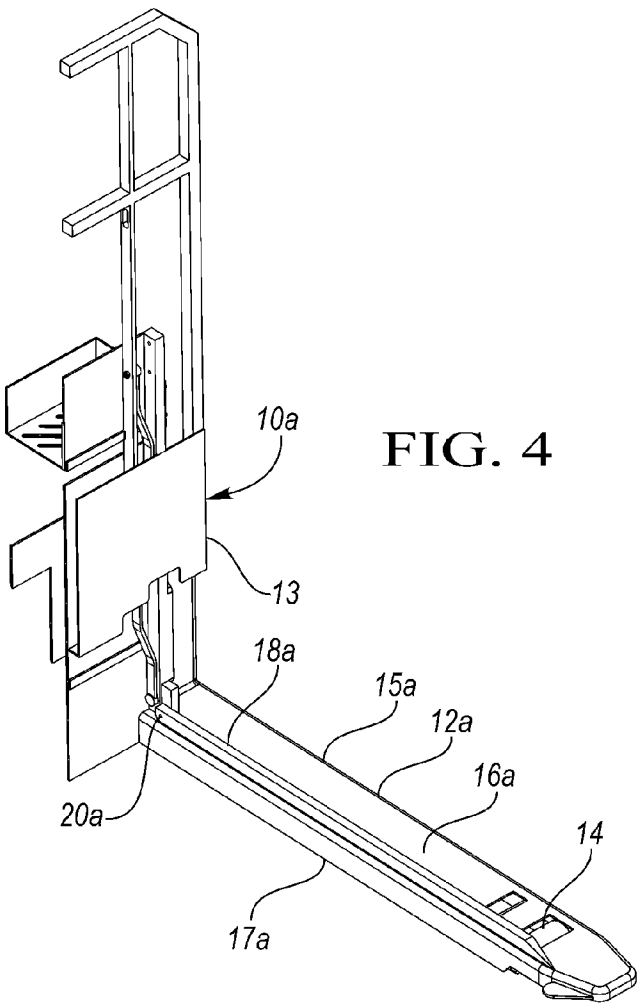
FIG. 4 shows the half pallet lift of FIG. 3 with the lift rail in the deployed position.
Figure 3:
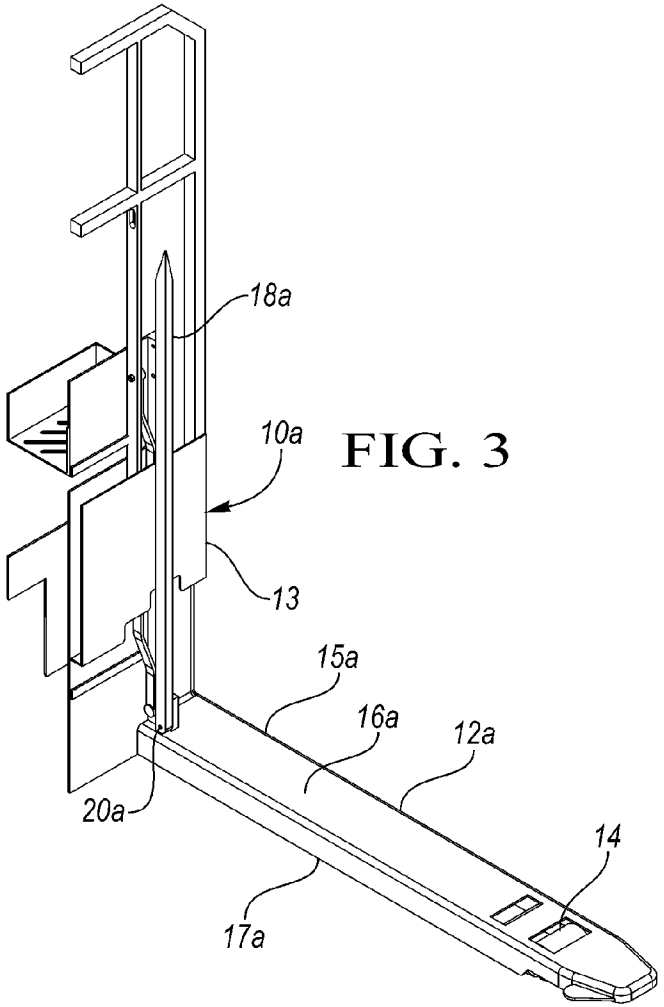
FIG. 3 is a perspective view of one half of a pallet lift according to a second embodiment, with the lift rail in a retracted position.

FIGS. 3 and 4 show a lift 10*a* according to another embodiment. Only one of the two fork tine assemblies 12*a* is illustrated. The other would be mirror image. The fork tine assembly 12*a* includes a tine 15*a* having a roller 14 and an upper surface 16*a*. The tine 15*a* has an innermost surface 17*a* facing the other tine 15*a* (not shown). In the stowed position shown in FIG. 3, the lift rail 18*a* is pivoted about a hinge 20*a* adjacent the lift mechanism to an upright position adjacent the lift mechanism 13. The lift rail 18*a* may be locked in the upright position by a clip, detent or other lock. In the stowed position, the lift rail 18*a* is not the innermost surface between the fork tine assemblies 12*a* at any point along the length of the fork tine assemblies 12*a*. In the stowed position, the lift rail 18*a* is spaced outwardly (away from the other fork tine assembly 12*a*) from the innermost surface 17*a* (i.e. the surface facing the other fork tine assembly 12) of the tine 15.

To deploy the lift rail 18*a*, the lift rail 18 is pivoted downward onto the fork tine assembly 12*a*. The lift rail 18*a* is on the upper surface 16*a* of the fork tine assembly 12*a* adjacent the inner edge thereof so that a pallet can be lifted from adjacent a similar pallet. In the deployed position, the lift rail 18*a* protrudes upwardly of the upper support surface 16*a* of the tine 15*a*. The lift rail 18*a* provides a lift rail support surface higher than the upper support surface 16*a* of the tine 15*a* when the lift rail 18*a* is in the deployed position. In the deployed position, the lift rail 18*a* is not the innermost surface between the fork tine assemblies 12*a* at any point along the length of the fork tine assemblies 12*a*. In the deployed position, the lift rail 18*a* is spaced slightly outwardly (away from the other fork tine assembly 12*a*) from the innermost surface 17*a* (i.e. the surface facing the other fork tine assembly 12*a*) of the tine 15*a*.

Figure 5:
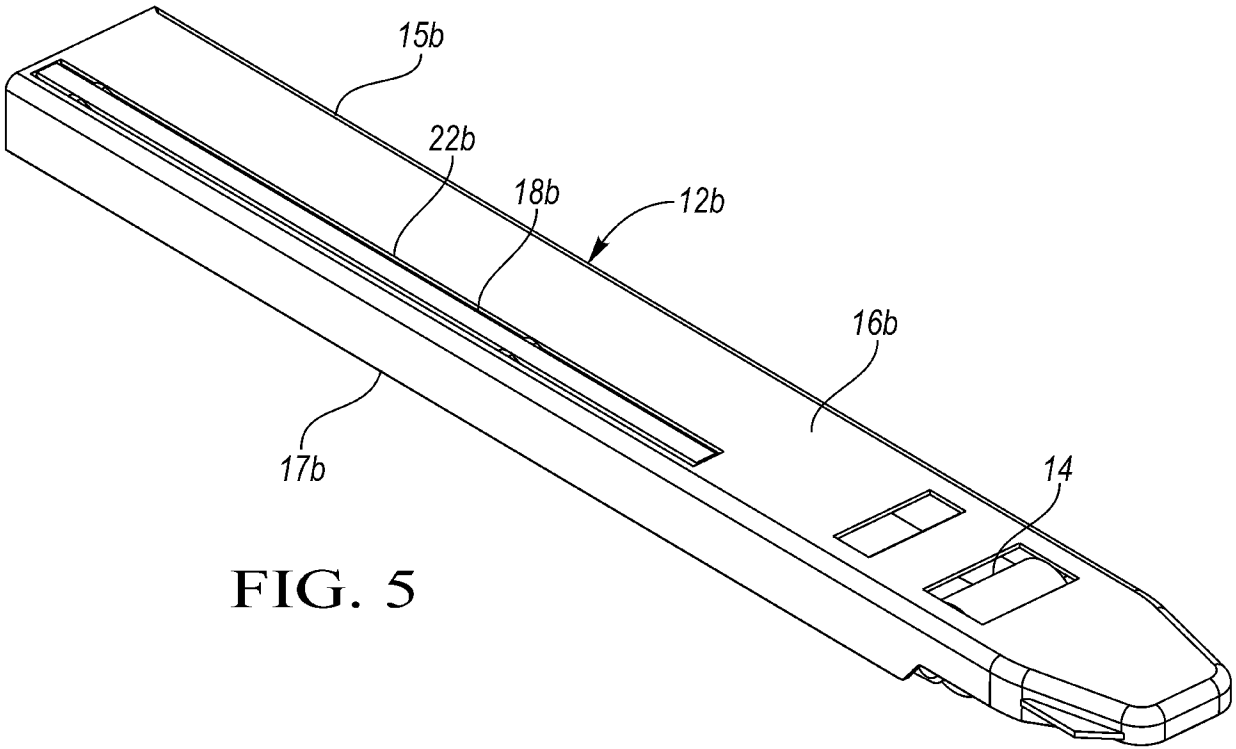
FIG. 5 shows a pallet lift tine according to a third embodiment with the lift rail in the retracted position.
Figure 6:
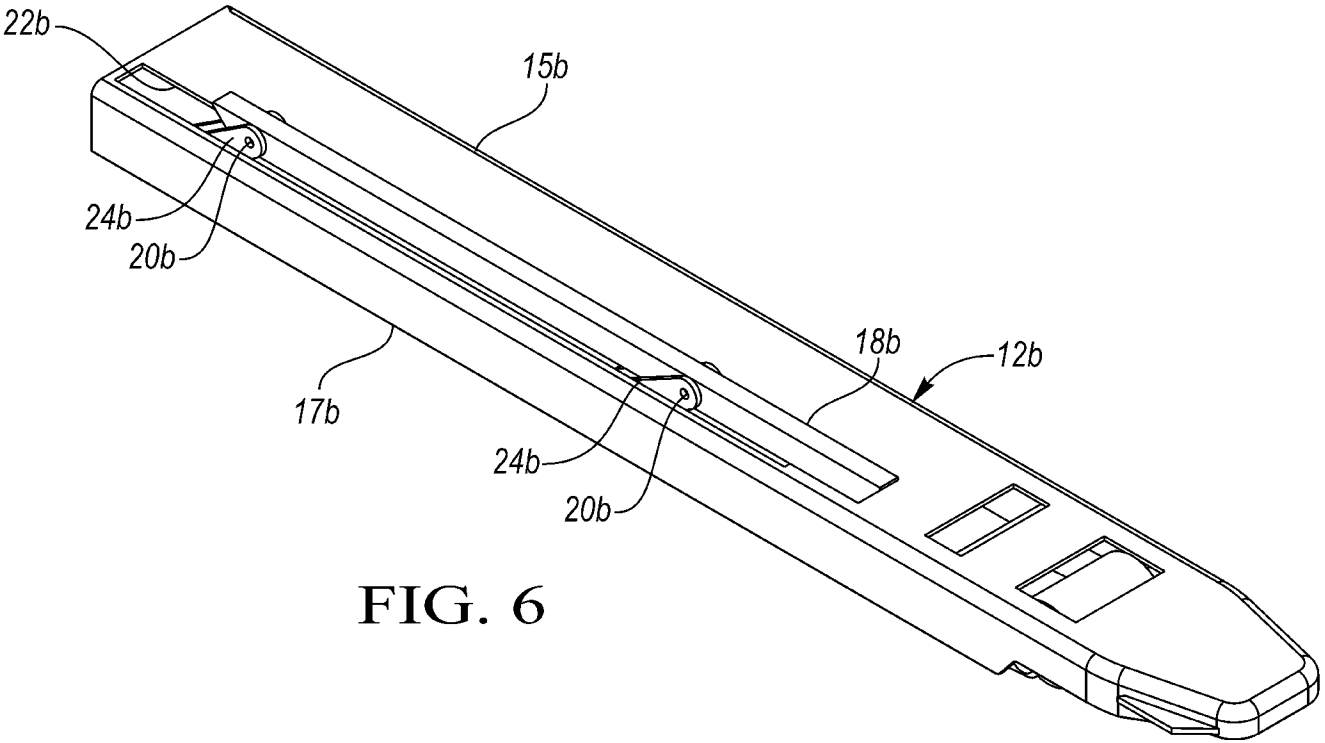
FIG. 6 shows the pallet lift tine of FIG. 5 with the lift rail in the deployed position.

FIGS. 5 and 6 show a fork tine assembly 12*b* according to another embodiment. The fork tine assembly 12*b* includes a tine 15*b* having a roller 14 adjacent an outer end thereof. A retractable lift rail 18*b* is positioned adjacent an inner edge of the upper surface 16*b* of the tine 15*b*. In the stowed position of the FIG. 5, the lift rail 18*b* is retracted into a recess or opening 22*b* in the upper surface 16*b* of the tine 15*b*. For use, the lift rail 18*b* is lifted and pulled forward to the deployed position shown in FIG. 6, where it may be locked in place by a detent or latch. The lift rail 18*b* is lifted out of the recess or opening 22*b* and pivoted outward on a plurality of pivotably connected arms 24*b*, pivotably connected at one end to the lift rail 18*b* at the other end to the tine 15*b*. In the deployed position, the lift rail 18*b* protrudes upwardly of the upper support surface 16*b* of the tine 15*b*. The lift rail 18*b* provides a lift rail support surface higher than the upper support surface 16*b* of the tine 15*b* when the lift rail 18*b* is in the deployed position. The lift rail 18*b* is positioned along the inner edge of the upper surface 16*b* of each tine 15*b* so that a pallet can be lifted from adjacent a similar pallet. The lift rail 18*b* could be moved from the stowed position of FIG. 5 to the deployed position of FIG. 6 manually or by an actuator or by mechanical linkage, such as by a ratchet locking foot pedal (like a parking brake).

Figure 7:
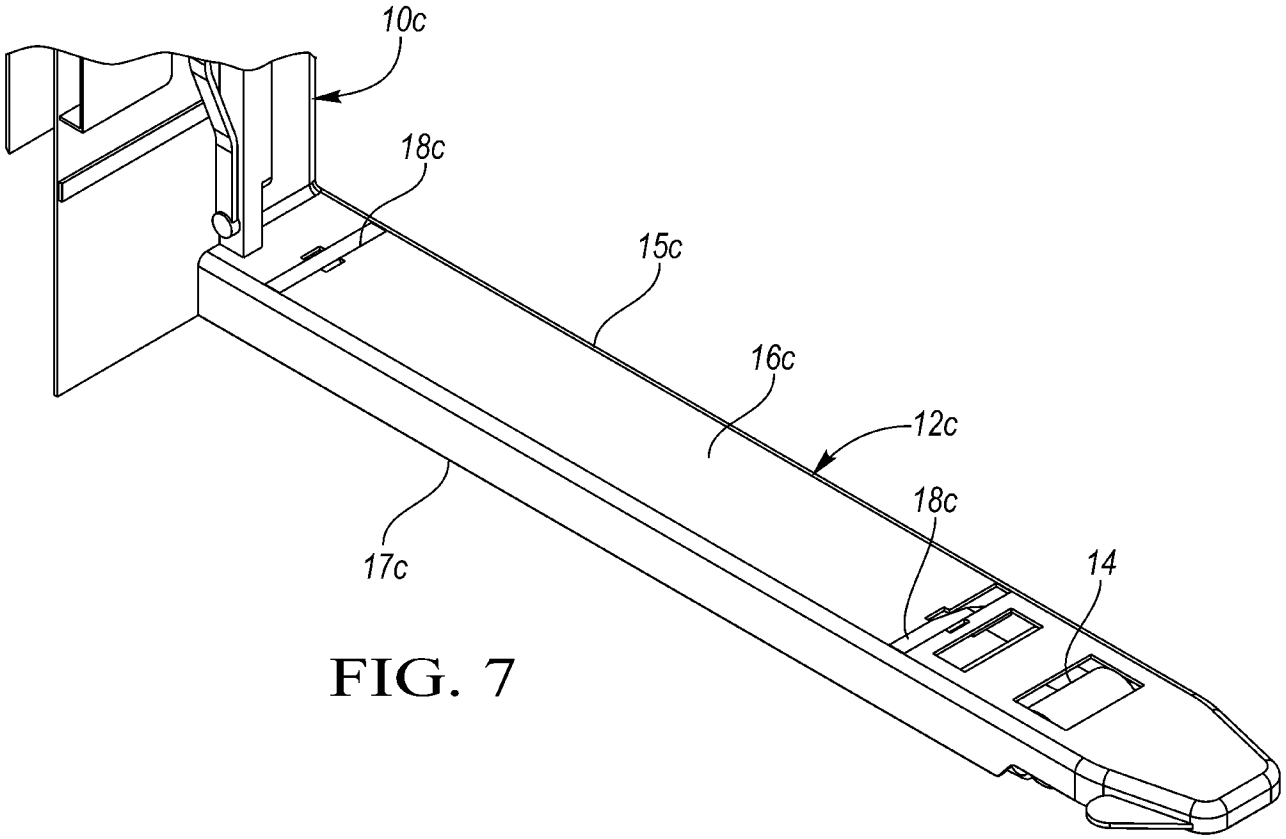
FIG. 7 shows a pallet lift tine according to a fourth embodiment with the lift rails in the retracted position.
Figure 8:
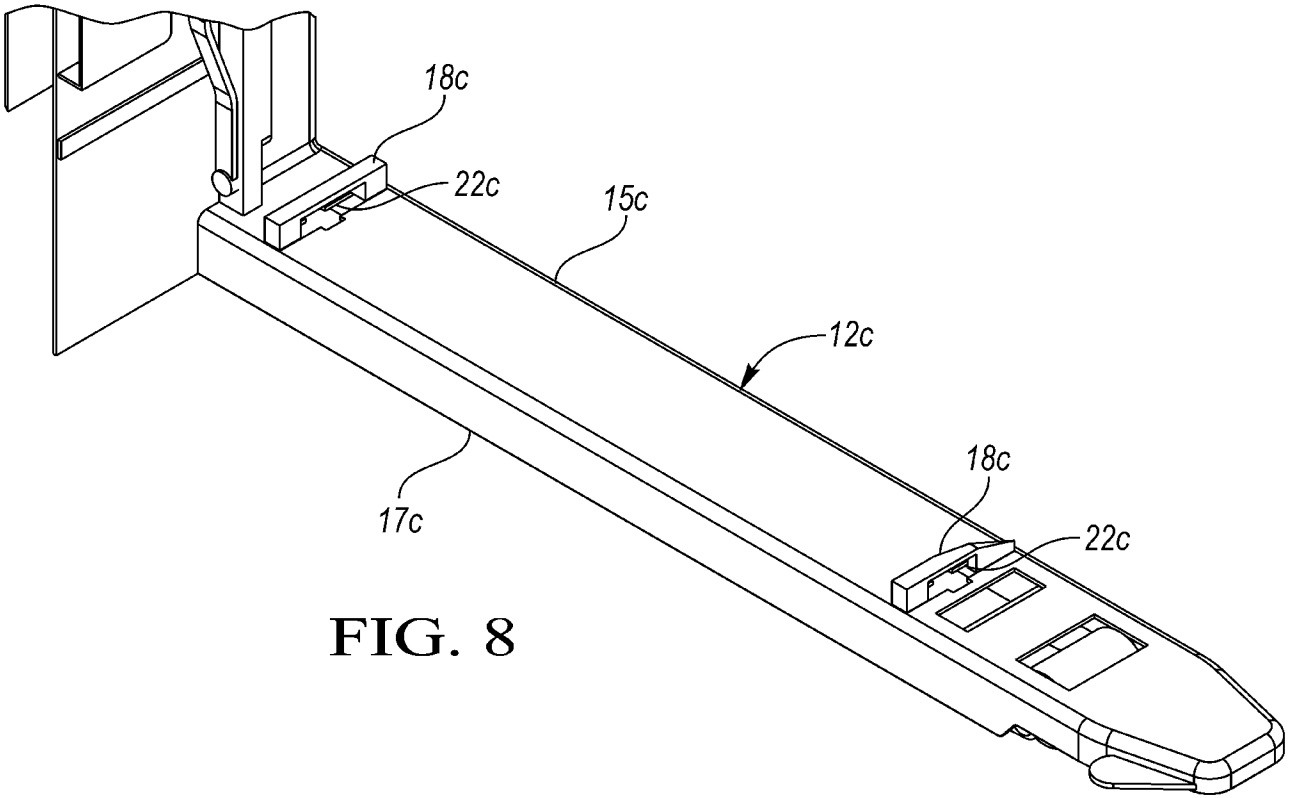
FIG. 8 shows the pallet lift tine of FIG. 7 with the lift rail in a partially deployed position.
Figure 9:
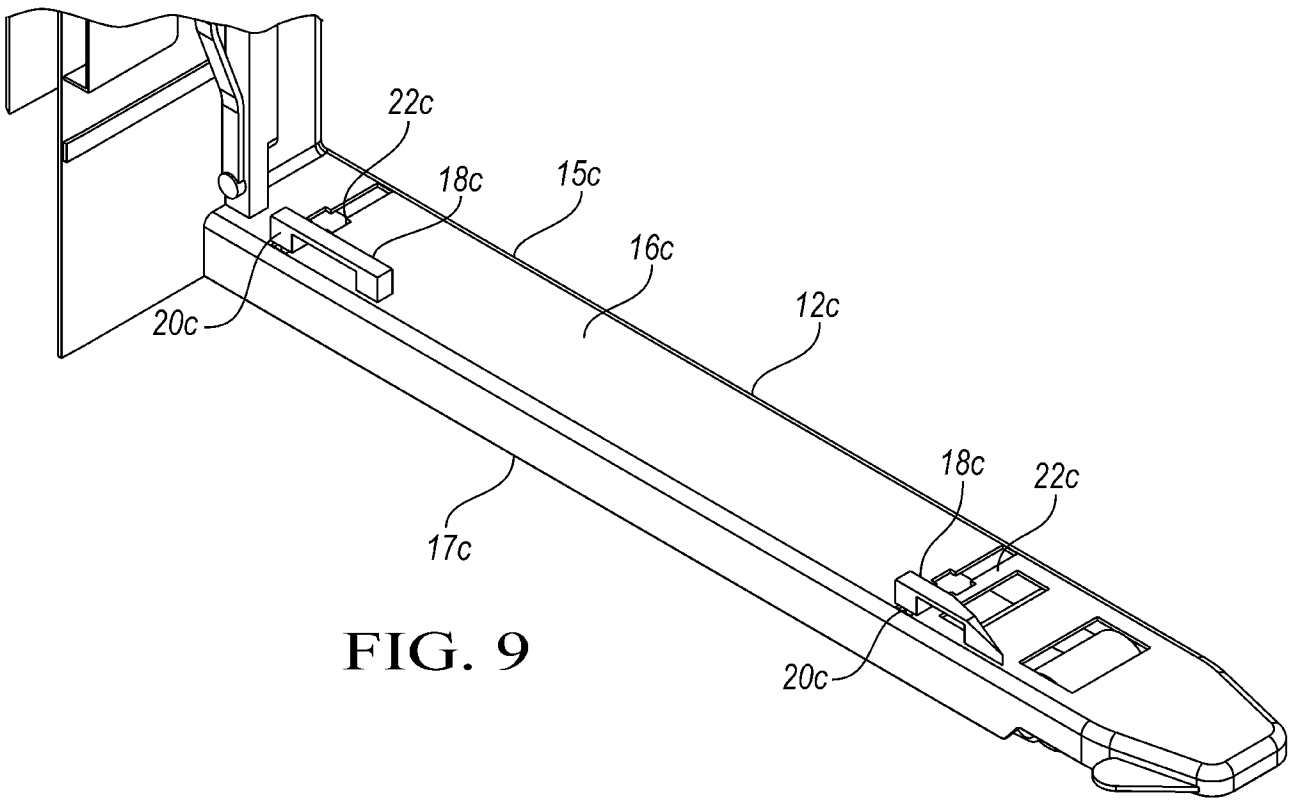
FIG. 9 shows the pallet lift tine of FIG. 7 with the lift rails in the deployed position.

FIGS. 7-9 show another embodiment of a pallet lift 10*c* and fork tine assembly 12*c*. The fork tine assembly 12*c* includes a tine 15*c* having a plurality of lift rails 18*c* stored flush inside pockets, recesses or openings 22*c*. The openings 22*c* are generally perpendicular (or at least transverse) to the inner edge 17*c* of the tine 15*c*. The lift rails 18*c* are flush inside the openings 22*c* when in the stowed position. In the stowed position, the lift rails 18*c* are not the innermost surface of the fork tine assemblies 12.

For deployment, the lift rails 18*c* are first lifted out of their openings 22*c* as shown in FIG. 8. The lift rails 18*c* are then rotated 90 degrees to the deployed position shown in FIG. 9. The lift rails 18*c* in the deployed position are adjacent and parallel to the inner edges of the fork tine assemblies 12*c*. In the deployed position, the lift rail 18*c* protrudes upwardly of the upper support surface 16*c* of the tine 15*c*. The lift rail 18*c* provides a lift rail support surface higher than the upper support surface 16*c* of the tine 15*c* when the lift rail 18*c* is in the deployed position. In the deployed position, the lift rails 18*c* are spaced slightly outwardly of the innermost edge 17*c* of the tine 15*c*. The lift rails 18*c* protrude upwardly of the uppermost support surface of the tine 15*c*. Although two rails 18*c* per fork tine assembly 12*c* are shown, more could be used.

Figure 10:
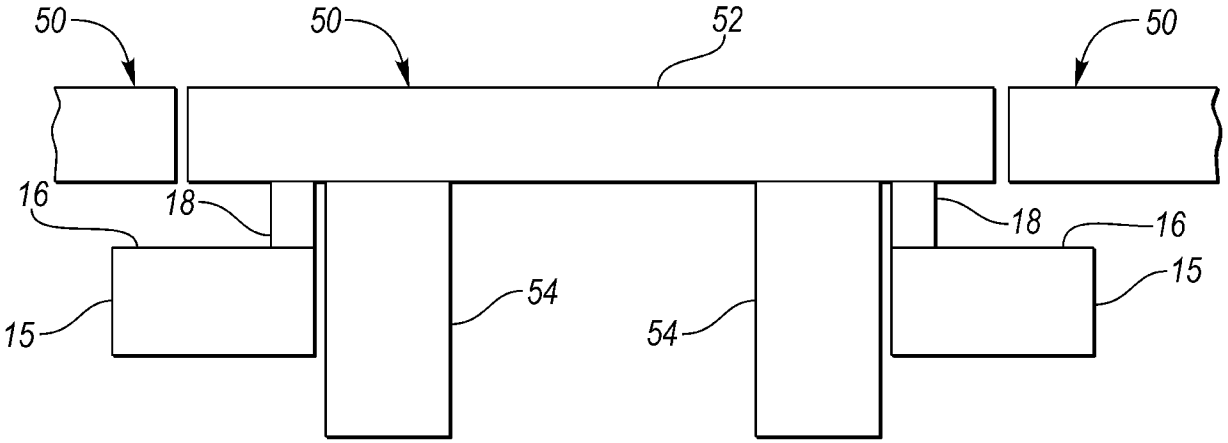
FIG. 10 is a schematic end view showing a pair of tines with deployed lift rails engaging a deck of a pallet between two other pallets.

FIG. 10 is a schematic end view showing a pair of tines 16 with deployed lift rails 18 engaging a deck 52 of a pallet 50 between two other pallets 50. The pallets 50 each have a plurality of columns 54 supporting the deck 52. The tines 15 engage the underside of the deck 52 outward of the columns 54. The lift rails 18 provide a smaller uppermost surface so that only one pallet deck 52 is engaged, without engaging the decks 52 of the adjacent pallets 50. FIG. 10 could be the tines 15, 15*a*, 15*b*, 15*c* and lift rails 18, 18*a*, 18*b*, 18*c* of any of the disclosed embodiments, shown generically as tines 15 and lift rails 18.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A pallet lift including a pair of fork tine assemblies, each fork tine assembly comprising:

a tine having a support surface and a pair of opposed lateral sides extending downward from the support surface and extending parallel to a long axis of the tine, wherein one of the opposed lateral sides is an inner lateral side and the other of the opposed lateral sides is an outer lateral side, such that the inner lateral side is inward of the outer lateral side, and such that the inner lateral sides of the pair of fork tines face one another; and a lift rail movable between a retracted position and a deployed position on the tine adjacent the inner lateral side, wherein the lift rail provides a lift rail support surface higher than the support surface of the tine when the lift rail is in the deployed position, wherein the lift rail is elongated and is connected at one lateral edge to the tine and pivotable about an axis parallel to a longitudinal axis of the tine between the retracted position and the deployed position, wherein the lift rail is pivotable inward from the retracted position to the deployed position, wherein a first surface of the lift rail faces upward in the retracted position and wherein the first surface of the lift rail faces inward in the deployed position, such that the first surfaces of the lift rails face one another in the deployed position.

2. The pallet lift of claim 1 wherein the lift rail of each fork tine assembly is retractable into a recess on the tine when in the retracted position.

3. The pallet lift of claim 2 wherein the lift rail projects upward vertically in the deployed position and is generally horizontal and coplanar with the support surface of the tine when in the retracted position.

4. The pallet lift of claim 2 wherein a first surface of the lift rail faces upward in the retracted position and wherein the first surface of the lift rail faces inward in the deployed position, and wherein the first surface of the lift rail is substantially flush with the support surface of the tine when the lift rail is in the retracted position.

5. The pallet lift of claim 4 wherein the lift rail is pivotable about ninety degrees from the retracted position to the deployed position.

6. The pallet lift of claim 5 further including a roller at an outer end of each tine.

7. The pallet lift of claim 1 wherein the lift rail of each fork tine assembly is pivotably connected to the tine.

8. The pallet lift of claim 7 wherein the lift rail of each fork tine assembly is retractable into a recess on the tine when in the retracted position.

9. The pallet lift of claim 7 further including a roller at an end of the tine of each fork tine assembly.

10. The pallet lift of claim 1 wherein each fork tine assembly is operatively secured to a lift mechanism.

11. The pallet lift of claim 1 wherein the lift rail is not a lateralmost surface of the tine assembly when the lift rail is in the retracted position and when the lift rail is in the deployed position.

12. The pallet lift of claim 1 wherein the axis is proximate the inner lateral side of the tine.

13. The pallet lift of claim 1 wherein the one lateral edge of the lift rail is closer to the inner lateral side of the tine than is the other lateral edge of the lift rail when the lift rail is in the retracted position.

14. The pallet lift of claim 13 wherein the lift rail is pivotable about ninety degrees from the retracted position to the deployed position.

15. The pallet lift of claim 1 wherein the first surface of the lift rail is substantially flush with the support surface of the tine when the lift rail is in the retracted position.

16. A fork tine assembly comprising:

a tine having a support surface and a pair of opposed lateral sides extending downward from the support surface and extending parallel to a long axis of the tine; and a lift rail movable between a retracted position and a deployed position on the tine, wherein the lift rail provides a lift rail support surface higher than the support surface of the tine when the lift rail is in the deployed position, the lift rail extending longitudinally generally parallel to the tine when the lift rail is in the deployed position, wherein the lift rail is a first lift rail and further including a second lift rail, wherein the second lift rail is movable between a deployed position and a retracted position on the tine, wherein the first and second lift rails are liftable out of openings in the tine and then rotatable about axes transverse to the support surface of the tine to move the first and second lift rails from the retracted position to the deployed position.

17. A pallet lift including a pair of the fork tine assemblies of claim 16, each operatively secured to a lift mechanism.

18. A pallet lift including the fork tine assembly of claim 16 operatively secured to a lift mechanism.

19. The fork tine assembly of claim 16 further including a roller at an end of the tine.

20. A pallet lift including the fork tine assembly of claim 16 operatively secured to a lift mechanism and further including a roller at an end of the tine.

21. A lift comprising:

a lift mechanism; and a pair of fork tine assemblies operatively secured to the lift mechanism, each of the fork tine assemblies including a tine having a support surface and an elongated lift rail pivotable about one longitudinal end thereof between a retracted position adjacent the lift mechanism and generally perpendicular to a longitudinal axis of the tine, and a deployed position generally parallel to the longitudinal axis of the tine, the elongated lift rail pivotable about an axis adjacent the lift mechanism, wherein in the deployed position the pair of lift rails are spaced apart from one another to be capable of receiving a plurality of columns of a pallet therebetween, wherein the lift rails provides lift rail support surfaces higher than the upper surfaces of the tines when the lift rails are in the deployed position.

22. The lift of claim 21 further including a roller at an outer end of the tine.

23. A pallet lift including a pair of fork tine assemblies, each fork tine assembly comprising:

a tine having a support surface and a pair of opposed lateral sides extending downward from the support surface and extending parallel to a long axis of the tine, wherein one of the opposed lateral sides is an inner lateral side and the other of the opposed lateral sides is an outer lateral side, such that the inner lateral side is inward of the outer lateral side, and such that the inner lateral sides of the pair of fork tines face one another; and a lift rail movable between a retracted position and a deployed position on the tine adjacent the inner lateral side, wherein the lift rail provides a lift rail support surface higher than the support surface of the tine when the lift rail is in the deployed position, wherein the lift rail is elongated and is connected at one lateral edge to the tine and pivotable about an axis parallel to a longitudinal axis of the tine between the retracted position and the deployed position, wherein the lift rail is pivotable inward from the retracted position to the deployed position, wherein a first surface of the lift rail faces upward in the retracted position and wherein the first surface of the lift rail faces inward in the deployed position, and wherein the first surface of the lift rail is substantially flush with the support surface of the tine when the lift rail is in the retracted position.

* * * * *